United States Patent [19]

Stettner

[11] 4,332,455

[45] Jun. 1, 1982

[54] ARCHIVAL PRINT AND FILM WASHER

[76] Inventor: Louis J. Stettner, 172 W. 79th St., New York, N.Y. 10024

[21] Appl. No.: 148,956

[22] Filed: May 12, 1980

[51] Int. Cl.[3] ..... G03D 3/02

[52] U.S. Cl. ..... 354/324; 354/335; 354/344; 366/166; 134/182; 134/199

[58] Field of Search ..... 354/315, 324, 325, 328, 354/331, 335, 337, 326, 344; 366/165, 166, 167; 134/182, 186, 198, 199

[56] References Cited

U.S. PATENT DOCUMENTS

| | | | |
|---|---|---|---|
| 670,165 | 3/1901 | Sheppard | 354/315 |
| 1,265,291 | 5/1918 | Bergman | 366/166 |
| 2,469,825 | 5/1949 | Hornstein | 366/165 |
| 2,508,886 | 5/1950 | Morse | 354/331 |
| 3,657,990 | 4/1972 | Wilhelm | 354/331 |
| 4,143,976 | 3/1979 | Paterson | 354/331 |
| 4,168,117 | 9/1979 | Work | 354/331 |

*Primary Examiner*—L. T. Hix
*Assistant Examiner*—Alan Mathews
*Attorney, Agent, or Firm*—Kirschstein, Kirschstein, Ottinger & Cobrin

[57] ABSTRACT

A photographic print and film washer which achieves the washing of photographic sheet material to archival quality. The washer features a liquid supply element for introducing a continuous stream of washer liquid under pressure to the interior compartment of a basin, to generate therein a hydrodynamic, generally horizontal, circumferentially-extending, generally laminar liquid flow. The basin has wall portions bounding an interior compartment for containing the photographic material to be washed. The interior compartment is bounded by an inner circumferential wall surrounding the photographic material. The washer liquid supply element includes a liquid inlet element in fluid communication with the interior compartment of the basin, and operative for continuously admitting washer liquid therein in a generally circumferential direction for washing the photographic material, and a washer liquid discharge facility for discharging spent washer liquid from the interior compartment of the basin. The liquid discharge facility works both circumferentially, hydrodynamically and gravitationally (hypo or fixer, the contaminating element, is heavier than water).

20 Claims, 13 Drawing Figures

FIG. 9
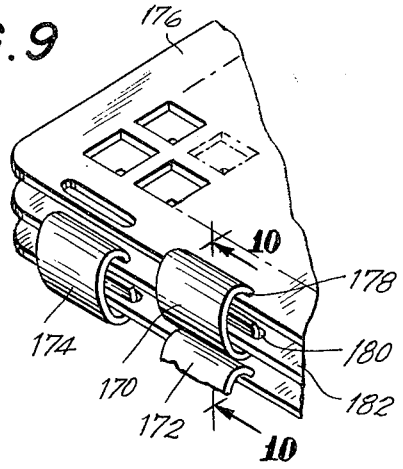
FIG. 10
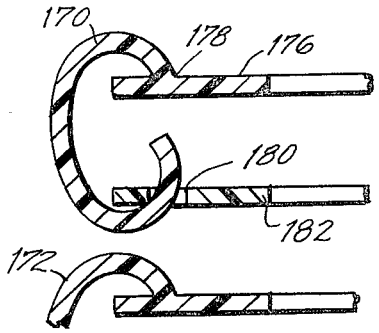
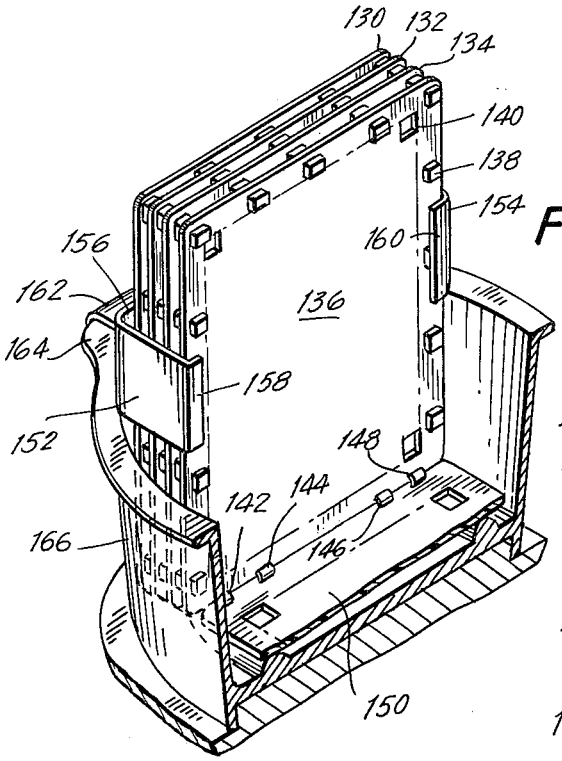
FIG. 11
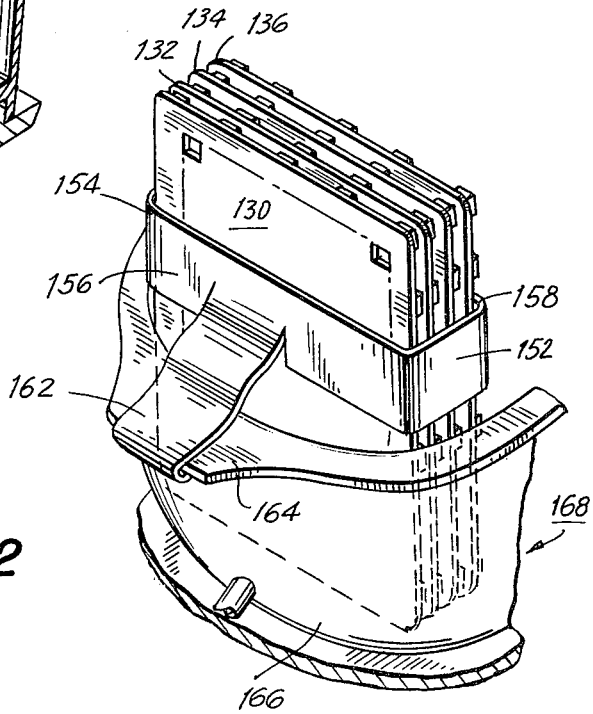
FIG. 12

ARCHIVAL PRINT AND FILM WASHER

BACKGROUND OF THE INVENTION

1. Field of the Invention

A washer for washing photographic sheet material.

2. Description of the Prior Art

The archival processing of photographic prints and film is a technique designed to enhance the useful life of the print and film, so that it may be stored, exhibited and/or shown and viewed in museums and the like, for many years without fading or otherwise deteriorating. Ideally and theoretically, photographic print and film should last in good condition for over two hundred years, if properly washed free of the processing chemicals used in the making of the finished product print and film. Most photographic prints and films in the prior art have not been processed by procedures or techniques which insure maximum possible permanence, principally because inexpensive technology, facilities and apparatus is not generally available at a reasonable cost to accomplish this. Also, the laborious hand process for rendering a print archival, was too time-consuming to be feasible for the entire production of a photographer. Thus, most photographers are familiar with the results of improper processing and storage of photographs. Old photo albums are usually excellent case studies of photographic fading, staining, and other forms of degradation.

One of the most tedious steps in the prior art of making a permanent print free of stain and/or fading over long periods of time was the washing process, in which residual sodium thiosulfate (fixer, hypo etc.) and other chemicals used in the development, fixing and toning of photographs are washed off of the print or film and removed using hypo-eliminator solution, followed by extended washing of the finished print or film with water. Thorough washing requires that all areas of the photographic material be subjected to a constant flow of water, coming into contact with all surface areas of the sheet for sufficient periods of time so that residual chemicals diffuse and are carried away from the photographic emulsion and its support base. Most prior art print washers cannot satisfactorily be used to wash more than a few prints at a time if archival results are to be achieved. Most print washers have no adequate provision for keeping prints separated during the washing process, and also suffer from low water exchange rates due to the large volume of water they hold. Previous print washers do not set up a circumferential, hydrodynamic flow at a steady rate, that consistently reaches all areas of the prints.

Thus, most photographers interested in making archival prints have had to settle for the time-consuming method of hand-rotating prints in trays of running water. In addition, heretofore most washers designed to wash paper photographic prints have had no provision for insuring the separation of one print from another, which is necessary if a constant flow of clean water is to reach all areas of the print. Most previous print washers attempt to move the prints about by some physical means, in an effort to separate the prints from each other from time to time. This movement often results in damaged corners of the prints or abraded emulsions, especially with large-size prints. Attempts to separate prints by physical means, such as high velocity water jets, rotating drums etc. have generally been ineffectual with large-size prints, and have generally resulted in uneven or incomplete washing of the prints. Furthermore, most previous print washers hold a relatively large amount of water at any given time, which requires a large volume of water flow and long periods of time for the chemicals diffused from the prints to be diluted to a safe level. In addition, most previous print washers allow prints to float on the surface of the water when the washer is not in operation. This leads to uneven washing of areas of the prints. This means that prints should be removed from such washers soon after washing is completed, which places limits on the automatic operation of such washers. In addition, all previous archival washers using any type of flexible separator were limited to prints 11×14 inches maximum, and could not accommodate larger size prints such as up to 16×20 inches.

In one prior art washer for sheets of photographic material, as described in U.S. Pat. No. 3,657,990, the washer tank has a fluid inlet near the bottom including an aerator for introducing a mixture of fine bubbles and water into a horizontal distribution manifold at the bottom of the tank. The top of the manifold is a horizontal septum perforated throughout its area with small perforations. The aerator has a vertical air inlet tube extending from the fluid inlet to above the overflow level of the tank. A number of parallel compartments are provided for holding individual sheets; these are so arranged that there can be no fluid contamination between compartments. Thus each print is washed in its own separate vertical compartment by a constant flow of air-turbulated water circulating on both sides of the print. This gives a wash to all parts of every print, while using only a small amount of water. The prints do not move physically while washing, instead the water circulates around them. This prevents damage to prints and print corners regardless of the length of wash time.

Another prior art procedure entails placing a stack of photographic print or film in a tray so that the stack is immersed in hypo-eliminator solution. The stack is shuffled like a deck of cards to accomplish manual mixing. Usualy 3 to 5 minutes were required for 12 photos typically 11 inches by 14 inches. Then the stack is placed in a tray of water, for rinsing the hypo-eliminator plus residual hypo from the print or film. Shuffling at this point in order to accomplish good washing usually required about one hour's time, which is impractical. In addition, leaving the stack in the tray for an hour was detrimental because the prints sometimes became stuck together, which was very bad for archival prints. Other disadvantages of this general procedure using a tray was that handling sometimes caused cracking of the prints, i.e. the emulsion would crack or the paper would crack. Usually the procedure required rough handling for an extended period of time, much too long for all practical purposes. In many cases, non-uniform rinsing took place because of the stack arrangement. The procedure was manual, expensive and tedious.

Non-archival print washers have also been used, but the problem was still sticking of the prints. Archival print washers do separate the prints, but there is non-uniform flow because of one inlet for the water and one outlet. The water speed varies as a function of the height of the print, leading to uneven washing. Also, in many previous archival washers, the water inlet is on the bottom and the outlet on the top, so that pockets of residual contamination (heavier than water) stay in the tank.

In addition, large amounts of water were required. One typical prior art archival print washer needed 5 to 8 gallons of water per minute, as well as a high pressure faucet. This washer still required two separate handling operations, i.e. one in a tray of hypo-eliminator solution, and the second in a tray of water. This washer also had the aforementioned print handling disadvantage. The vertical tank of the washer always had to be filled with water, otherwise, experience has shown that the joints swelled and eventually cracked if water was not left in; 5 gallons of water weighs about 42 pounds and storage is a problem. This procedure is also too time-consuming, typically 70 minutes being required for 12 prints 11"×14" black and white, for both the hypo-elimination step and the print washing. Also this washer was not effective because there was still a slight amount of hypo on the prints, as proved by the conventional silver nitrate test, which showed slight traces of hypo stain. A feasible and practical archival print washer, in order to produce a print that will last two hundred years without fading, or a print of museum quality, must eliminate all hypo in order to achieve this result. Ordinary prints have residual hypo on their surfaces, and will fade in 15 to 20 years.

SUMMARY OF THE INVENTION

1. Purposes of the Invention

It is an object of the present invention to provide an improved washer for washing photographic sheet material such as photographic print and film.

Another object is to provide an improved archival print and film washer.

A further object is to wash photographic print and film in an improved manner by means of a washer in which a hydro-dynamic, generally horizontal, circumferentially-extending, generally laminar flow of wash liquid is generated in the basin of the washer.

An additional object is to conserve wash water in the washing of photographic print and film.

Still another object is to provide a washer for washing photographic sheet material in which the prints or film does not have to be removed from a hypo-eliminator solution prior to a subsequent water washing stage.

An object is to provide such a washer in which handling time is reduced.

An object is to provide such a washer in which the risk of fracturing the paper base and the emulsion is completely eliminated.

An object is to provide such a washer which drastically eliminates handling from the time of hypo-eliminating and washing to the drying stage.

An object is to provide such a washer in which laminar flow is produced by a special streamlined design and oval tank which eliminates eddies or pockets in which residual hypo can remain in the tank.

An object is to provide such a washer in which the liquid discharge facility works both circumferentially, hydrodynamically and gravitationally.

An object is to provide such a washer including a flexible separator rack which can take prints up to 16×20 inches, as contrasted to all previous archival washers using any type of flexible separator, which were limited to prints 11×14 inches in maximum dimensions.

An object is to provide a washer that in case of water shortage, there will be no need for a continuous flow of water, but instead five changes of water (the prints remaining 15 minutes in each change) can be used to archivally wash prints and film.

An object is to provide such a washer in which less water is required because of a lower requisite flow rate as well as lessened time for the wash period, usually half the time of prior art washers.

An object is to provide such a washer in which the tank or basin does not need to be filled with water during non-use periods.

An object is to provide such a washer in which only a short time is required to produce excellent results of no residual hypo and no stain.

These and other objects and advantages of the present invention will become evident from the description which follows.

2. Brief Description of the Invention

In the present invention, by a system of hydrodynamic water flow and racks, sodium thiosulphate (fixer or hypo) is completely eliminated from photographic prints in 35 minutes. A silver nitrate test after this time shows absolutely no hypo in the prints. The washer also combines two photographic operations in one, eliminating tedious handling of prints that often causes cracking and fracturing of the emulsion and paper base of the photographic paper. Previously, photographic prints were put into a hypo eliminating solution, and continuously shuffled by hand like a deck of cards for the required time. They were then individually taken out of the tray and placed into a tank for washing. Both these operations can take place in the present washer without any intermediate handling of prints, resulting not only in no possible damage to the prints, but also in definite saving in time.

The procedure is as follows. The hypo eliminating solution is poured into the washer, and the entire rack (which holds twelve prints) is placed in the solution. After the required length of time (usually three minutes), the eliminating solution is poured out and the washing water immediately put into operation. The system of pipes in the tank not only directly sprays the prints, but by combining with the interior curves of the tank, sets up a hydrodynamic oval water flow (horizontally) which completely washes out hypo from the prints. The rack separates prints in the water, prevents any damage to them from the water flow, and is also designed for easy loading.

The hypo is eliminated from the tank by the hydrodynamic oval water flow and a system of outlets on the bottom, placed at the two lowest points of the tank (hypo is heavier than water). There is also a thermometer directly inserted into the water inlet, so that it can be maintained at the most desirable temperature, 75 degrees Fahrenheit.

The entire process, without any handling of prints, takes place in about 40 minutes while all other washing processes require at least one hour and twenty minutes (both times include the use of the hypo eliminating solution). The reduction in time is due to the placement of the water spray, and the interior curves of the tank. Since individual handling of the prints is eliminated in the hypo eliminating solution, possible damage to prints is non-existent.

All print washers on the market today concede and indicate a washing result in which a silver nitrate stain will result after one hour of washing, showing a minimum of acceptable hypo remaining in the prints that, it is claimed, will not seriously disturb the archival quality of the prints. The present washer will show no silver stain, resulting in absolute removal of all hypo in the prints, and producing archivally washed photographic prints that will last indefinitely without staining or fading.

In addition, the present washer, by the simple longitudinal insertion rods (which come with the washer in a commercial package), allows for the complete archival washing of photographic spool film in about twenty minutes (the time includes both the hypo-eliminating solution and the water flow).

To briefly summarize the procedural sequence of the present invention, a print rack and the present wash tank or basin are provided. The prints or film or other photographic sheet material are placed on the print rack. The print rack is then placed in the tank and anti-floating retaining strips are put in place over the rack. The tank is filled with hypo-eliminator solution by pouring it in over the top, to about one inch above the rack. The tank is then agitated (shaken from outside) a few times a minute, for 3 to 5 minutes. The tank is then drained by means of two lower outlets connected to an adjustable drain, which is moved to a down position, to drain the tank completely. Then the adjustable drain is moved to the up position. The tank is then filled with water to about one inch above the rack. A circumferential laminar flow of wash water is created by water discharge out through nozzles at a typical rate of 3 gallons per minute. This water flow is continued, typically for 35 minutes, while regulating the temperature to about 75 degrees Fahrenheit for best results; a thermometer is provided in the bath, as well as streams of hot and cold running water. Spent wash water discharges through the two outlets at the bottom of the tank during this 35 minute period, and overflows to waste via the adjustable drain (now in the up position). Finally, with residual water left in the tank, the rack is removed. Each print is then removed from the rack and physically swept with a squeegee or the like to remove most of the residual entrained water. Then the print is placed back in the rack and the entire rack is mounted or hung up to dry. If desired, the squeegee wiping step can be eliminated.

Additional advantageous aspects of the present archival print and film washer will now be mentioned. In the prior art rinsers, the prints had to be taken out one at a time, squeegeed, and then each print had to be separately hung up to dry, usually with wooden clips which left marks; or a dryer was used which ran the risk of contaminating the prints and also did not prevent curling. In the rack configuration of the present invention, the prints can be left in to dry without clips, without contamination, and without excessive curling (due to the fact that each print curls only until it reaches the next grille of the rack).

Another disadvantage of prior art rinsers is that they had to be completely filled, even for washing one print. In the present washer, by adjusting the position of the adjustable drain, the washer need only be filled to a level sufficient to wash one or more prints. In prior art print racks, it was difficult to insert a wet limp print into the old narrow slots; in the present configuration there are flexible grilles which open apart to permit easy entry. In addition, by the provision of an insertable support rod, reels of rolled film can be mounted in the present washer and washed, in a technique usually reserved for archival film. Finally, in the present washer, lower arcuate support baffles on the bottom of the tank keep the lower prints out of the contaminating element, sodium thiosulphate solution or hypo, which settles to the bottom of the tank or basin for removal (the hypo solution is denser than water). These support baffles also assist in laminar flow.

Besides the advantages indicated supra, the present invention provides numerous other salient advantages. The present improved archival print and film washer, for washing photographic sheet material such as photographic print and film, produces archival quality print and film in an improved manner by means of a washer in which a hydrodynamic, generally horizontal, circumferentially-extending, generally laminar flow of wash liquid is generated in the basin of the washer. The present washer conserves wash water in the washing of photographic print and film, and is of benefit to the ecology. In areas where there is not enough water, or where the pressure is low, the prints can be rendered archival by staying in five successive changes of water for fifteen minutes in each change of water (with occasional agitation of the tank). The hypo will naturally leach out to the discharge outlets, which are the lowest points in the tank. The contours of the bottom of the tank are so designed as to assist and direct the flow of the contaminating element to the outlets. The liquid discharge facility works both circumferentially, hydrodynamically and gravitationally (hypo or fixer, the contaminating element, is heavier than water). All previous archival washers using any type of flexible separator were limited to prints $11\times14$ inches in maximum dimension, while the archival print and film washer of the present invention can take prints up to $16\times20$ inches. In the present washer, the prints or film do not have to be removed from a hypo-eliminator solution, prior to a subsequent water washing stage. Handling time as well as the risk of fracturing the paper base are reduced. The present washer drastically eliminates physical handling, from the time of hypo-eliminating and washing to the drying stage. Laminar flow is produced in the present washer by a special streamlined design and oval tank which eliminates eddies. Less wash water is required, because of a lower requisite flow rate as well as lessened time for the wash period, which is usually about half the time of prior art washers. The tank or basin does not need to be filled with water during non-use periods. Finally, only a short time is required to produce excellent results of no residual hypo and no stain.

The invention accordingly consists in the features of construction, combination of elements, arrangement of parts and series of steps which will be exemplified in the method, device, and article of manufacture hereinafter described, and of which the scope of application is as elucidated supra and as will be indicated in the appended claims.

BRIEF DESCRIPTION OF THE DRAWINGS

In the accompanying drawings in which is shown one of the various possible embodiments of the invention:

FIG. 9 is a perspective view of a portion of an alternative embodiment of a rack for handling photographic material in sheet form;

FIG. 10 is a partial sectional elevation view taken substantially along the line 10—10 of FIG. 9;

FIG. 11 is a perspective view of the alternative rack in place in the basin of a washer as viewed from the front; and FIG. 12 is a perspective view of the alternative rack in place in the washer basin, as viewed from the rear.

DETAILED DESCRIPTION OF THE PREFERRED EMBODIMENTS

Figure 1:
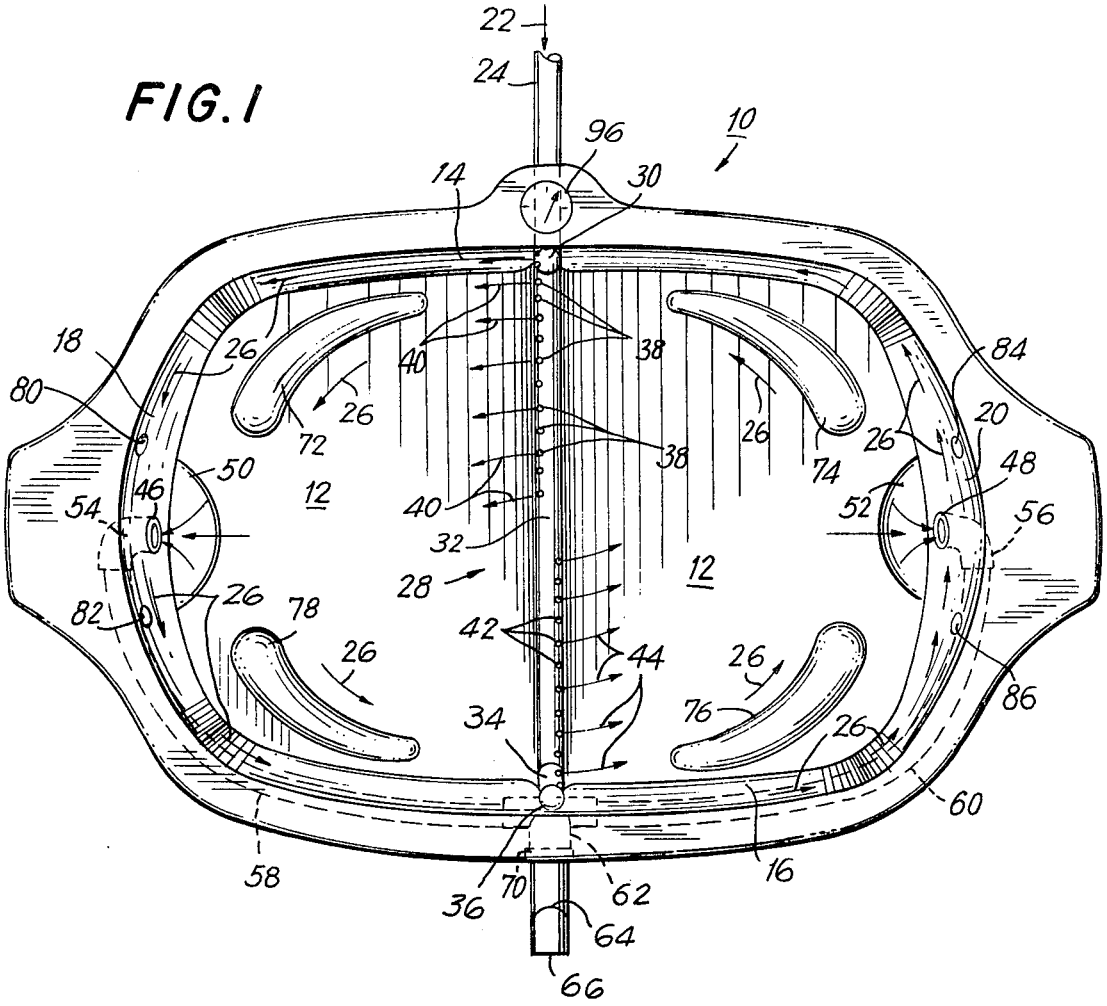
FIG. 1 is a plan view of the present washer, prior to the placing of a rack therein.

Referring now to the Figures, the present archival print and film washer for washing photographic sheet material includes a basin or tank generally designated as 10. The basin 10 as shown has wall portions bounding an interior compartment for containing the photographic material to be washed. The interior compartment of the basin 10 is bounded by the inner circumferential surface of the basin 10 which surrounds the photographic material. Washer liquid supply means, to be described in detail infra, is provided for introducing a continuous stream of washer liquid, e.g. water, under pressure and into the interior compartment of the basin 10, to generate therein a hydrodynamic, generally horizontal, circumferentially-extending, generally laminar liquid flow. As will appear infra, the washer liquid supply means includes liquid inlet means in fluid communication with the interior compartment of the basin 10, the liquid inlet means being operative for continuously admitting washer liquid e.g. water therein in a generally circumferential direction for washing the photographic material. The washer is completed in its broadest and most general embodiment by the provision of washer liquid discharge means for discharging spent washer liquid from the interior compartment of the basin.

As will appear infra, in a preferred embodiment the washer liquid supply means admits the washer liquid stream, e.g. water, parallel to the inner surface and in two portions, one portion being admitted in one direction on one side of the interior compartment, the other portion being admitted in a direction opposite to the one direction on the other side of the interior compartment. In this preferred embodiment, typically the washer liquid supply means is a continuous foraminous pipe which extends centrally in the interior compartment and generally transverse to a portion of the inner wall, one half of the pipe having foramina which face generally horizontally in one direction, the other half of the pipe having foramina which face generally horizontally in a direction opposite to the one direction. In a preferred embodiment as shown, and as will be described in detail infra, each half of the continuous foraminous pipe has a continuous generally horizontal component and a generally vertical component. Typically, each horizontal component of the pipe is on the bottom of the interior compartment, and the two vertical components are spaced apart, one vertical component being adjacent to one side of the interior compartment, and the other vertical component being adjacent to a side of the interior compartment opposite to the aforementioned one side.

The present archival photographic print and film washer will now be described in detail. The washer as shown in the Figures includes the generally rectangular basin 10. The basin 10 has a generally horizontal bottom wall generally designated as 12. The bottom wall 12, albeit generally horizontal, is sloped downwards towards the end walls and the end lower liquid outlets. The basin 10 has two opposed side walls 14 and 16, as well as two opposed end walls 18 and 20. As shown, the side and end walls extend upwards from the bottom wall 12, and the side and end walls have an interior curvature as shown such that a stream 22 of wash liquid e.g. water, when admitted via pipe 24 into a body of liquid, as shown, in the basin 10, generates a hydrodynamic substantially horizontal circumferential laminar liquid flow within the body of liquid in the basin 10, as indicated by the arrows 26.

A foraminous pipe, generally designated as 28, extends centrally in the basin 10 and transversely across the basin 10 between the two opposed side walls 14, 16 of the basin 10. The pipe 28 has a generally rectilinear and vertical inlet section 30, and the pipe 24 connects with inlet section 30 so that the liquid stream 22 is admitted into the inlet section 30 of the pipe 28 proximately at the top of the basin 10, as shown. In addition, as shown, the inlet section 30 extends downwards from the pipe 24 proximately to the bottom wall 12 of the basin 10.

The foraminous pipe 28 also has a generally rectilinear and horizontal lower transverse section 32, and a generally rectilinear and vertical outlet section 34. The lower transverse section 32 of the pipe 28, as shown, is contiguous with the bottom wall 12 of the basin 10, and extends generally horizontally between the lower ends of the inlet section 30 and the outlet section 34. The outlet section 34 terminates at a closure 36 proximately at the top of the basin 10.

In this preferred embodiment of the invention and as shown, foramina 38 in the inlet section 30 and associated adjacent half of the lower transverse section 32 of the pipe 28 are on one side of the pipe 28, so that as indicated by arrows 40, a first portion of the washing liquid stream 22 is discharged into the body of liquid in the basin 10 in one direction and generally on one side of the basin 10 parallel and adjacent to the side wall 14. The foramina 42 in the outlet section 34 and associated adjacent half of the lower transverse section 32 of the pipe 28 are on the other side of the pipe 28 as compared to the foramina 38, so that the balance of the liquid (water) stream 22 is discharged into the body of liquid in the basin 10 in a direction opposite to the aforementioned one direction, and generally on the other side of the basin 10 parallel and adjacent to the side wall 16, as indicated by the arrows 44. Thus as shown, the liquid discharges via arrows 40 and 44 operate in tandem to generate the flow of washing liquid in the basin 10 as indicated by the arrows 26 and as described supra. In this case the washing liquid flow is counterclockwise within the basin 10, as shown by the arrows 26. It is evident that the introduction of washing liquid stream 22 into the basin 10 necessitates the provision of means to remove spent washing liquid from the basin 10; a preferred removal means will be described infra.

Figure 7:
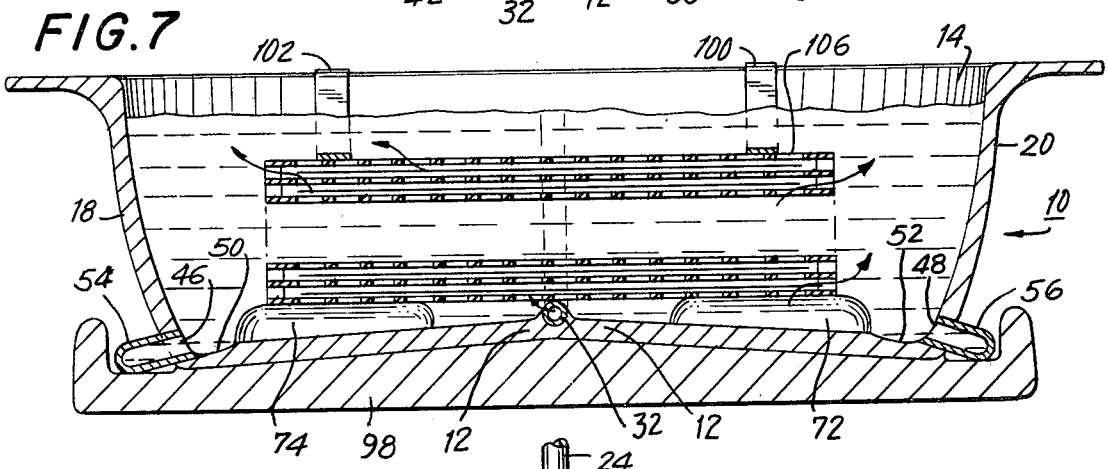
FIG. 7 is a sectional elevation view taken substantially along the line 7—7 of FIG. 4.

In a preferred embodiment of the invention and as shown, the side walls 14, 16 of the basin 10 are longer than the end walls 18, 20 of the basin 10. In addition and as shown, the side walls 14, 16, 18 and 20, and the bottom wall 12, all slant downwards to drainage outlets 46, 48 disposed centrally at the bottom of the respective end walls 18, 20, so that these outlets 46, 48 are at the lowest points in the tank or basin 10. The laterally downwards sloping of the two halves of the bottom wall 12 is best seen in FIG. 7. Thus, centrifugal force and gravity forces residual hypo and eliminator to the outlets 46, 48. The curvature of the basin 10, especially at the ends of the tank or basin 10, are such that water is also forced downwards towards the outlets 46, 48. It will be appreciated that hypo can also be eliminated by leaching, instead of continual flow of water. Five changes of 20 minutes each, with occasional agitation, will cause hypo to naturally collect by gravity in the depressions 50, 52 as shown in the bottom wall 12, adjacent to the respective drainage holes 46, 48. Of course, the rate of diffusion of hypo from photographic paper is greatly speeded up by continual flow of water. However, water costs in photography can be expensive, and the alternative feature of allowing the hypo to be eliminated by standing and only five changes is unique and most helpful in ecology. In this regard, all other washers of the prior art have straight strictly horizontal bottoms.

As mentioned supra, the spent liquid (water) outlets 46, 48 from the tank or basin 10 are located proximately centrally at the bottom of the respective end walls 18, 20, and each half of the bottom wall 12 slopes downwards from the lower transverse section 32 of the pipe 38 to a liquid outlet 46 or 48, as best seen in FIG. 7. In addition, opposed depressions, cavities or sinks 50 and 52 are provided in the bottom wall 12 of the basin 10 adjacent the respective liquid outlets 46 and 48. These liquid outlets 46 and 48 connect to respective elbows 54, 56, which in turn have a liquid transfer connection via respective pipe lengths 58, 60 to a tee fitting 62, which passes the liquid flowing through both pipes 58, 60 to a generally vertical riser pipe 64 which terminates at a spent washing liquid outlet opening 66 (discharging via stream 68 to a drainage facility), the opening 66 being proximately at the top of the basin 10, so that the level of the top of the liquid body in basin 10 is preserved above that of the photographic sheet material being washed (see FIG. 6).

In a preferred embodiment of the invention and as shown, the lower end of the riser pipe 64 is swivelable about the tee 62, by the provision of a swivel connection 70 between the tee 62 and the pipe 64. Thus, the riser pipe 64 may be swiveled to an orientation, as shown in phantom outline in FIG. 2, in which the outlet opening 66 is lower than the liquid outlet openings 46, 48, so that the basin 10 may be virtually completely emptied of liquid contents, e.g. spent wash liquid such as water, or hypo eliminator. It will also be appreciated that the riser pipe 64 may be tilted to any intermediate disposition between vertically upright and the phantom outline position shown in FIG. 2. This expedient may be adopted during operation of the washer, so as to maintain a lower liquid level in the basin 10, as when concentrated washing of a lesser amount or lower level of photographic sheet material is desired.

Figure 5:
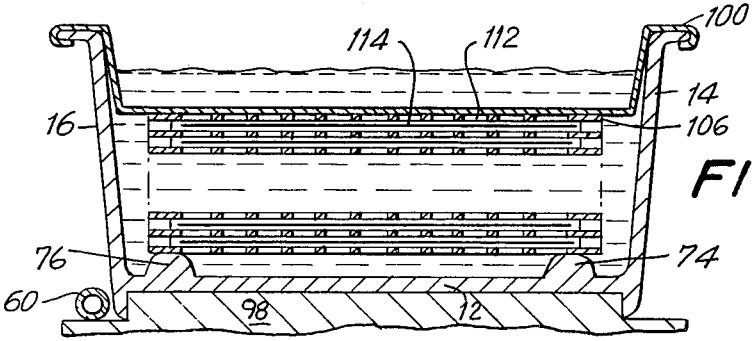
FIG. 5 is a sectional elevation view taken substantially along the line 5—5 of FIG. 4.

Referring now to FIGS. 1, 5 and 7, in this preferred embodiment of the invention, four arcuate guide baffles 72, 74, 76 and 78 for guiding liquid flow are provided in the bottom wall 12 of the basin 10. These guide baffles rise from the bottom wall 12 of the basin 10 and as shown, the baffles 72, 74, 76 and 78 each curve to conform to the curvature of the basin 10 at the junction between one of the side walls and one of the end walls. Each guide baffle is oriented adjacent to, but spaced from, one of these walls junctions, as shown (FIG. 1). As best seen in FIG. 7, the bottom wall 12 of the basin 10 slopes downwards away from the end of each guide baffle which is closest to the transverse pipe section 32, and the top surface of each guide baffle (e.g. 74, 72) is generally horizontal. Further, as best seen in FIG. 1, the lower portion of each guide baffle, i.e. that portion closest to an end wall 18 or 20, is wider than the upper portion of the guide baffle.

Figure 8:
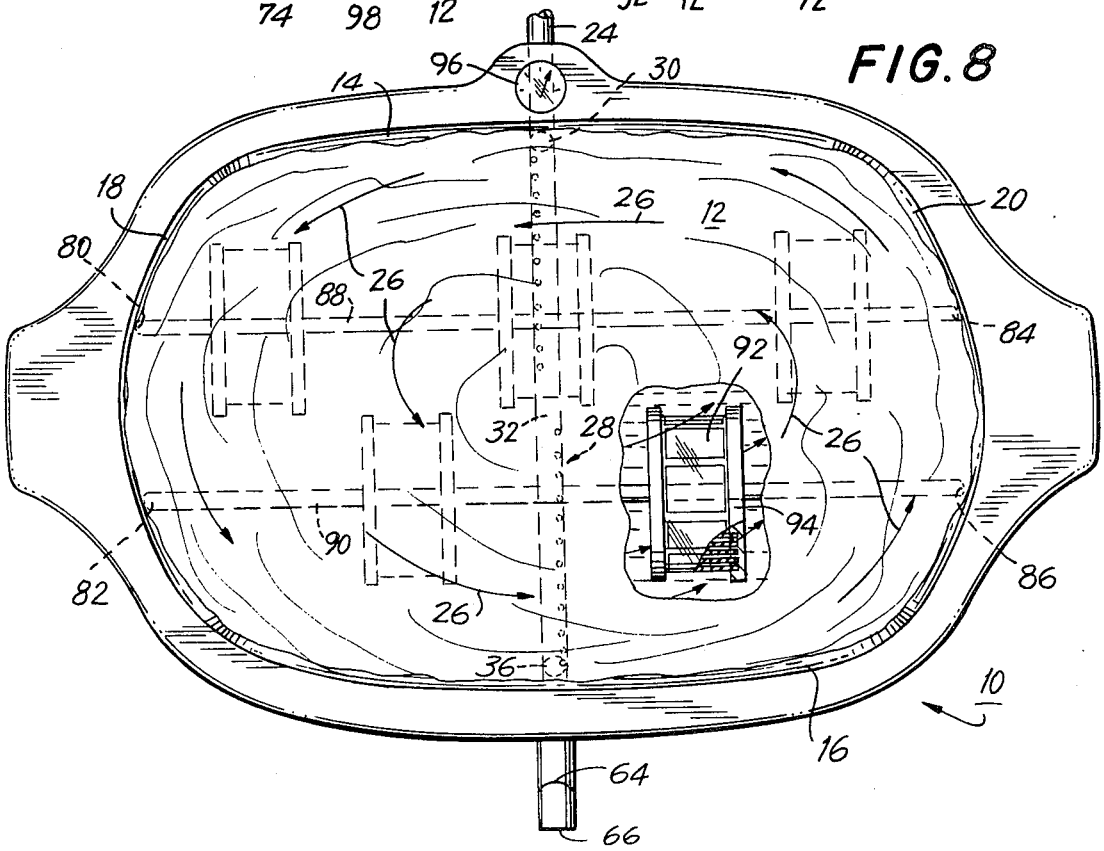
FIG. 8 is a plan view showing the present washer as constituted for the washing of rolls of film on film spools.

In one alternative embodiment of the present invention, the washer may be employed to provide archival washing of rolls of film or print. Thus recesses 80 and 82 are provided in the end wall 18, and recesses 84 and 86 are provided in the end wall 20. Each of these recesses is provided to accommodate the end of a support rod (FIG. 8), so that at least one support rod may be mounted in the basin 10, to support and suspend a roll or rolls of film mounted on one or a plurality of film spools. Thus as shown in FIG. 8 in phantom outline, support rod 88 extends between recesses 80 and 84 and support rod 90 extends between recesses 82 and 86. A roll 92 of film or print is mounted on film spool 94 which in turn is suspended in the body of wash liquid by virtue of being mounted on support rod 90. Other film spools are shown in phantom outline in FIG. 8.

A thermometer 96 is mounted to the basin 10, and extends into the pipe 24, so that the temperature of liquid stream 22 may be measured and controlled, as stream 22 passes through pipe 24 and into inlet section 30 of the pipe 28.

Figure 2:
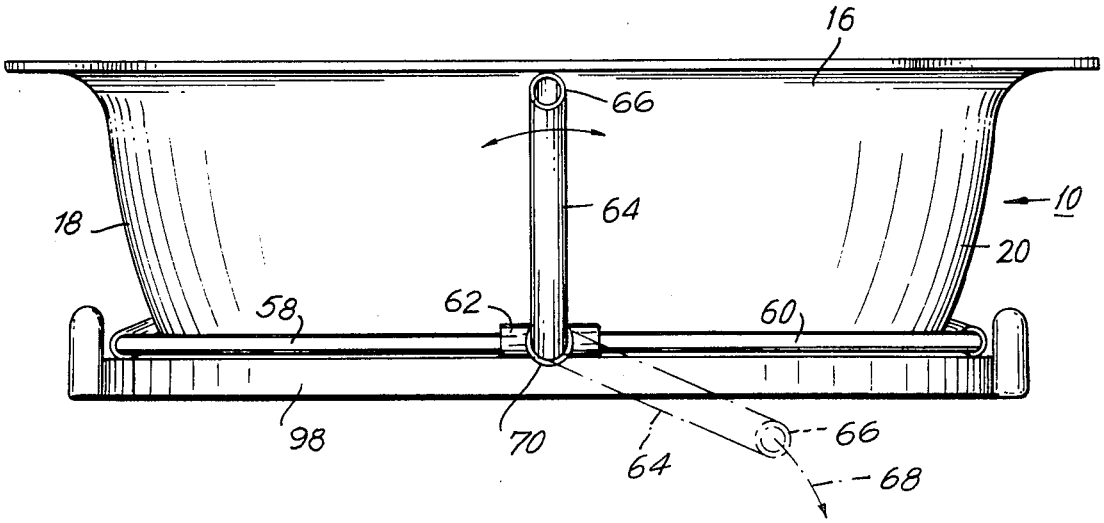
FIG. 2 is an elevation view of the washer showing the adjustable drain.
Figure 6:
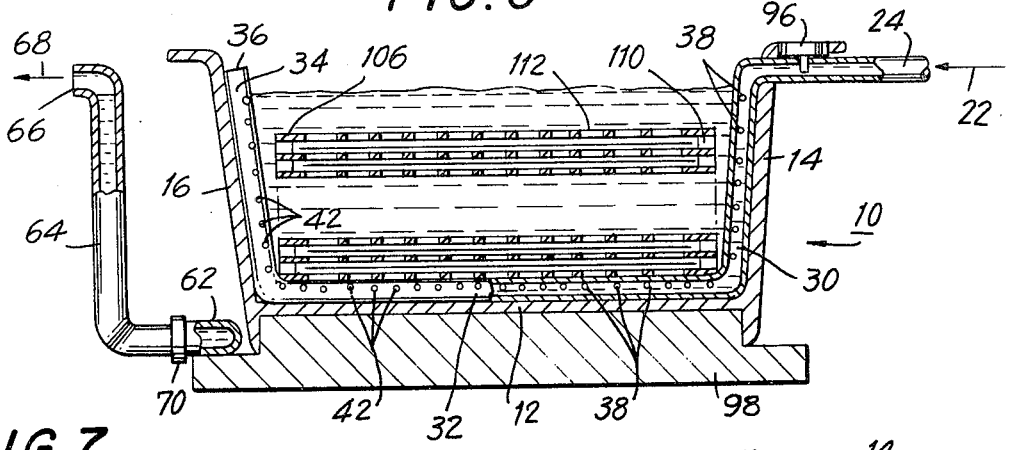
FIG. 6 is a sectional elevation view taken substantially along the line 6—6 of FIG. 4.

As best seen in FIGS. 2, 6 and 7, the basin 10 is supported on a discrete generally planar support member 98, with the upper surface of the member 98 conforming to the lower surface of the bottom wall 12 of the basin 10. The support member 98 serves to raise the basin 10, so that the basin 10, and associated basin pipe members, and other appurtenances thereto, cannot be bumped and damaged.

The basin 10 may be provided in conjunction with a suitable means to immerse a photographic print film rack (to be described infra) in the body of liquid in the basin 10. In this embodiment of the invention, the immersion means is two generally rectilinear retaining strips 100, 102, each retaining strip 100 or 102 being mounted as shown (FIGS. 4, 5 and 7) to the top of the basin 10, so that each retaining strip 100 or 102 extends from one side wall 14 of the basin 10 to the other side wall 16 of the basin 10. As best seen in the Figures, it is preferred that the side walls and the end walls of the basin 10 slope inwards towards the bottom wall 12. In most instances, the liquid involved in the washing of the photographic sheet material will be water, e.g. ordinary tap water, however in some specialized instances, e.g. color prints or film, other liquids known to those skilled in the art may be employed to wash the photographic sheet material.

In addition to the structural features of the present archival print and film washer considered as a device and article of manufacture, a new method of washing archival photographic sheet material is also contemplated as being within the scope of the present invention. This method generally entails the steps of containing photographic sheet material in a basin, e.g. the tank or basin 10, the basin having wall portions bounding an interior compartment for containing the photographic sheet material to be washed. The interior compartment is generally characterized by being bounded by an inner circumferential wall surrounding the photographic sheet material. A continuous stream of washer liquid is introduced under pressure to the interior compartment of the basin, to generate therein a hydrodynamic, generally horizontal, circumferentially-extending, generally laminar flow of the washing liquid stream. The washer liquid stream is continuously admitted to the interior compartment of the basin, as described supra, namely in a generally circumferential direction, for washing the photographic sheet material. The final step of the method in general is the discharging of spent washer liquid from the interior compartment of the basin. Preferred embodiments and specific procedural sequences of the method aspect of the present invention include those diverse aspects of the washing procedure as described supra, and as will be indicated in the appended claims.

Figure 4:
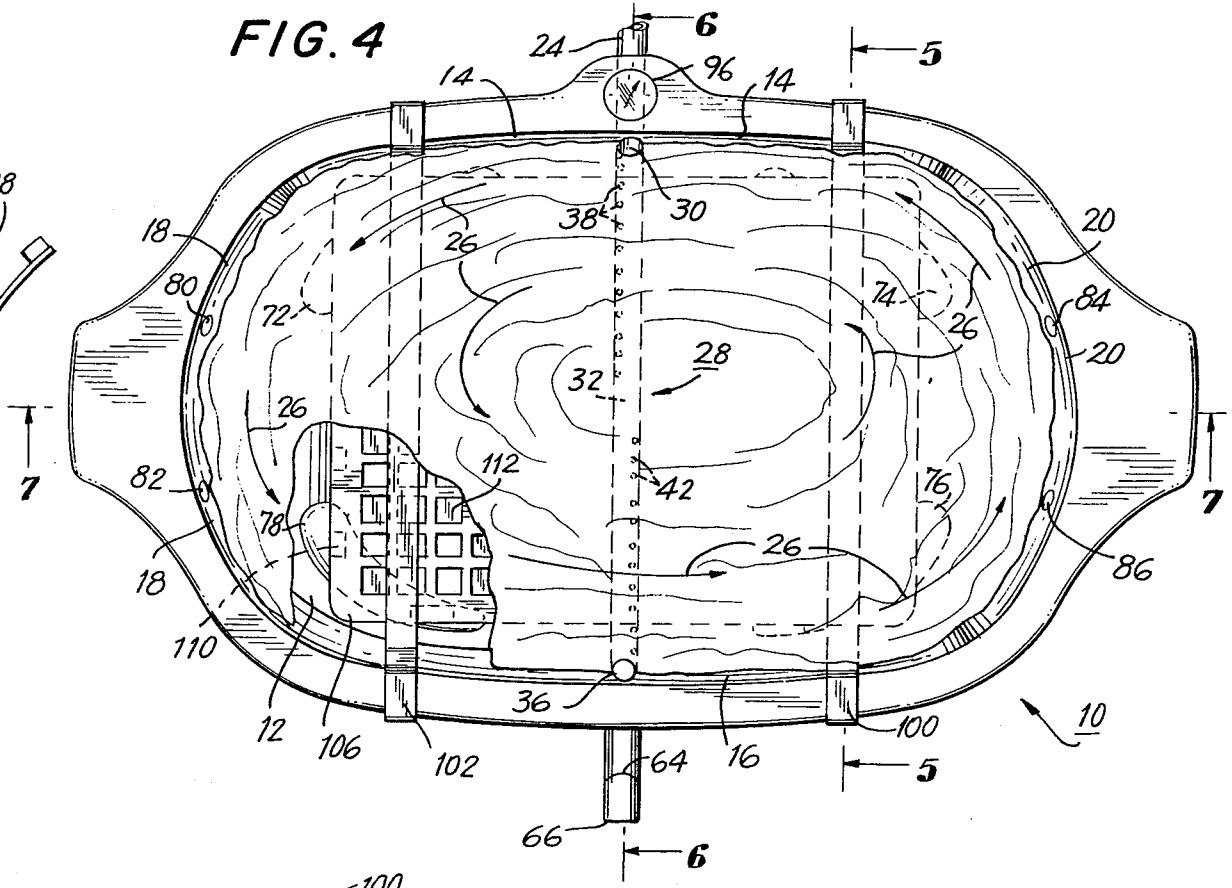
FIG. 4 is another plan view of the washer, now with the rack in place and during the wash period.
Figure 3A:
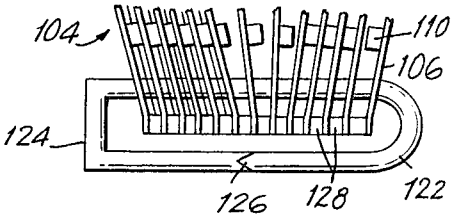
FIG. 3*a* shows a portion of an alternative embodiment of rack configuration within the scope of the present invention.
Figure 3:
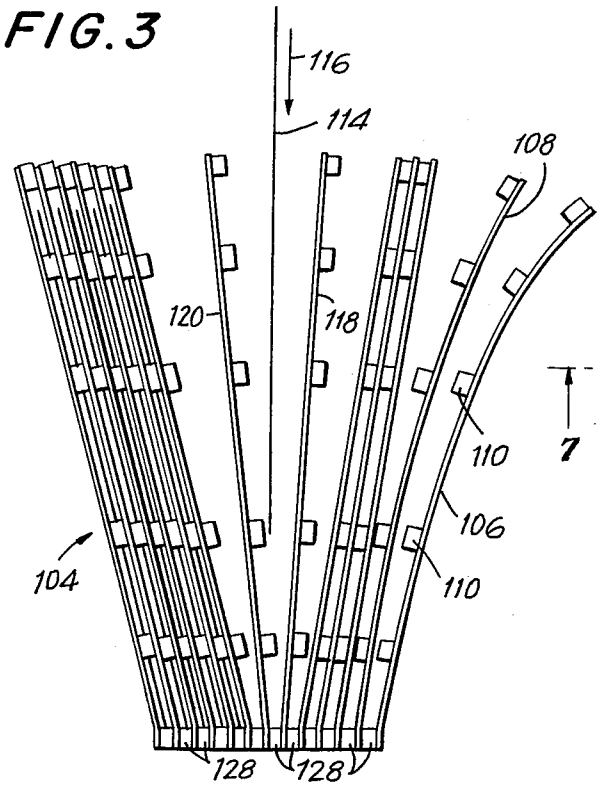
FIG. 3 shows the present rack configuration, with a sheet of photographic print or film being inserted between adjacent grilles of the rack.

Finally, the present invention also includes, as a preferred embodiment, a specific new rack configuration for holding and handling photographic sheet material or any photographic material in sheet form, considered as an article of menufacture. The present rack is shown in detail in FIG. 3, and is shown immersed in the body of washing liquid in basin 10 and held in position by the retaining strips 100, 102 in FIGS. 5, 6 and 7. Referring now to FIG. 3, the present rack, generally designated as 104, includes a plurality of generally parallel spaced-apart flexible generally planar partitions, panels or grilles such as partitions 106 and 108, juxtaposed one above another. These partitions such as 106 and 108 may be composed of plexiglass, methyl methacrylate, polyethylene, polypropylene especially isotactic polypropylene, bakelite, polyvinyl chloride, polyvinyl acetate, another suitable plastic known to the art, or a metal such as stainless steel, etc. A plurality of spacers such as e.g. spacers, 110 (partition 106) are provided about the periphery of each partition, and each partition is foraminous, being provided with a plurality of regularly spaced openings or perforations so that each partition is grilled. Thus FIG. 4 shows regularly spaced square openings such as opening 112 in partition 106. Suitable means is provided for interconnecting the flexible partitions along one of their respective side regions, such that their opposite side regions are movable relative to each other, to permit insertion of photographic sheet material such as sheets 114, (FIG. 3) as indicated by arrow 116 into the rack 104 between each two adjacent partitions, in this case partitions 118 and 120. Two different alternative interconnecting means are shown in FIGS. 3 and 3*a*. One such means (FIG. 3*a*) is a stainless steel or plastic safety pin type ring 122 which may be used to hold the sheet holders or partitions 106, 108, 118 and 120 together. The bottom 124 of the ring 122 is preferably flat so that the rack 104 will stand readily on a planar surface or in the basin 10. Coupling means 126 is usually provided midway on the ring 122, so that the partitions of the rack 104 are detachable from each other. Typically the ring 122 extends inwards about one inch from the edge of a normal size rack, and is about three inches wide. An alternative means for interconnecting the flexible partitions along one of their respective side regions, as shown in FIG. 3, consists in permanently attaching spacers 128 to each other in a rectilinear orientation.

Referring now to FIGS. 9, 10, 11 and 12, an alternative embodiment of a rack for handling photographic material in sheet form is shown. This alternative rack embodiment is advantageous in that a hinge arrangement is provided for the print rack partitions. In addition, a rack partitions holder is provided, so that both hands can be free and used for loading prints. The flexible rack partitions holder moves aside when pulling down on each rack, i.e. the holder has resiliently yieldable arms. The alternative rack configuration features hinges consisting of C-shaped tongues, each tongue being integral with a partition and extending into a slot in the next adjacent partition.

Thus, referring to FIGS. 9, 10, 11 and 12, the alternative rack features a plurality of photographic sheet-supporting partitions 130, 132, 134 and 136 separated by peripheral spacers such as spacer 138, see FIG. 11. These partitions as shown are juxtaposed in a generally vertical orientation, and in addition to being spaced-apart the partitions are flexible and generally planar. As shown, the partitions are foraminous, being provided with square openings such as opening 140. Lower hinge means is provided along the lower edge of each partition; thus, as shown in FIG. 11, the lower hinges 142, 144, 146 and 148 may be seen. One or more of these lower hinges extends between the front vertical partition 136 and adjacent partition 150, shown displaced and pivoted about the hinges to a horizontal disposition. The vertical partitions 136, 134, 132 and 130 are thus pivotable seriatim from a generally vertical orientation as shown to a generally horizontal orientation comparable to the partition 150. As each partition is successively manipulatively displaced from the vertical orientation to the horizontal orientation, a piece of photographic sheet material, e.g. a photographic film or print, is laid on top of the horizontal partition (such as partition 150), followed by the pivoted displacement of the next succeeding partition, e.g. 136, from the vertical to the horizontal position.

Referring further to FIGS. 11 and 12, flexible partition holding means is provided along both sides of the vertically upright partitions. The holding means detachably restrains the partitions in the generally vertical orientation as shown, so that each of the partitions is displaceable in turn, by manipulation, from a generally vertical orientation to a generally horizontal orientation. The holding means in this embodiment of the invention typically consists of two opposed resiliently yieldable arms 152, 154, and a connector strip 156 which extends between the arms 152 and 154. The arms 152, 154 as shown are generally perpendicular to the connector strip 156. The outer end of each arm has a finger extension, i.e. fingers 158, 160, which fingers are generally parallel to the connector strip. As shown, the fingers 158, 160 extend inwards and towards each other.

The rack is completed by the provision of restraining means 162 which extends from the holding means i.e. connector strip 156. The restraining means 162 is mounted to the upper horizontal lip portion 164 of the wall 166 of a basin, generally designated as 168, of a washer for washing photographic sheet material.

The hinge means is best seen in FIGS. 9 and 10. Each hinge such as elements 170, 172, 174 consists generally of a flexible C-shaped tongue integral with one partition, e.g. tongue 170 is integral with partition 176 at 178; the tongue 170 extends into a slot 180 in partition 182 adjacent to the partition 176. As best seen in FIG. 9, each successive hinge means is laterally offset from the previous hinge means, thus hinge 174 is laterally offset from hinge 170, and hinge 172 directly below hinge 170 is laterally offset from hinge 174.

It thus will be seen that there is provided a device and article of manufacture consisting of an archival print and film washer for the washing of photographic sheet material, a method of washing photographic sheet material, and an article of manufacture consisting of a rack for handling photographic material in sheet form, all of which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A washer for washing photographic sheet material, comprising:

(a) a basin having an interior compartment for containing the photographic material to be washed, said interior compartment being bounded by an inner circumferential surface surrounding the photographic material, (b) washer liquid supply means for introducing a continuous stream of washer liquid under pressure to the interior compartment of the basin, to generate therein a hydrodynamic, generally horizontal, circumferentially-extending, generally laminar liquid flow, said washer liquid supply means including liquid inlet means in fluid communication with the interior compartment of the basin, and operative for continuously admitting washer liquid therein in a generally circumferential direction for washing the photographic material, said washer liquid supply means further including a continuous foraminous pipe which extends centrally in the interior compartment generally transverse to a portion of the inner surface, one half of the pipe having foramina which face generally horizontally in one direction, and the other half of the pipe having foramina which face generally horizontally in a direction opposite to the one direction, ech half of the pipe having a continuous generally horizontal component and a generally vertical component, and (c) washer liquid discharge means for discharging spent washer liquid from the interior compartment of the basin.

2. The washer of claim 1 in which each horizontal component of the pipe is on the bottom of the interior compartment, and the two vertical components are spaced apart, one vertical component being adjacent to one side of the interior compartment and the other vertical component being adjacent to a side of the interior compartment opposite to said one side.

3. An archival photographic print and film washer, said washer comprising a generally rectangular basin, said basin having a generally horizontal bottom wall, two opposed side walls, and two opposed end walls, said side and end walls extending upwards from said bottom wall, the side and end walls of said basin having an interior curvature such that a stream of liquid when admitted into a body of liquid in said basin generates a hydrodynamic substantially horizontal circumferential laminar liquid flow within said basin, a foraminous pipe, said pipe extending centrally in said basin and transversely across said basin between the two opposed side walls of said basin, said pipe having a substantially rectilinear and vertical inlet section, means to admit a stream of liquid into said inlet section of said pipe proximately at the top of said basin, said inlet section extending downwards from said means to admit liquid proximately to the bottom of said basin, said pipe having a substantially rectilinear and horizontal lower transverse section and a substantially rectilinear and vertical outlet section, said lower transverse section of said pipe being contiguous with the bottom wall of said basin and extending substantially horizontally between the lower ends of said inlet section and said outlet section, said outlet section terminating at a closure proximately at the top of said basin, the foramina in the inlet section and associated adjacent half of the lower transverse section of said pipe being on one side of said pipe, the foramina in the outlet section and associated adjacent half of the lower transverse section of said pipe being on the other side of said pipe, and means to remove spent liquid from said basin.

4. The washer of claim 3 in which the side walls of the basin are longer than the end walls of the basin.

5. The washer of claim 3 in which the means to remove spent liquid from the basin is located proximately centrally at the bottom of at least one end wall of the basin, and the bottom wall of the basin slopes downwards towards the means to remove spend liquid from the basin.

6. The washer of claim 5 in which a depression, cavity or sink is provided in the bottom wall of the basin adjacent the means to remove spent liquid.

7. The washer of claim 5 in which the means to remove spend liquid is in two portions consisting of first and second opposed liquid outlets, each of said outlets being centrally disposed in the bottom of one of the end walls, one half of the bottom wall sloping downwards from the lower transverse section of the pipe to the first liquid outlet, and the other half of the bottom wall sloping downwards from the lower transverse section of the pipe to the second liquid outlet.

8. The washer of claim 5 in which the means to remove spend liquid extends to a generally vertical riser pipe, said riser pipe terminating at an outlet opening proximately at the top of the basin.

9. The washer of claim 8 in which the lower end of the riser pipe is swivelable, so that the riser pipe may be swiveled to an orientation in which the outlet opening is lower than the means to remove spent liquid, whereby the basin may be substantially completely emptied of spent liquid.

10. The washer of claim 3 in which at least one arcuate guide baffle is provided in the bottom wall of the basin, said guide baffle rising from the bottom wall of the basin and curving to conform to the curvature of the junction between a side wall and an end wall of the basin.

11. The washer of claim 10 in which four arcuate guide baffles are provided, each guide baffle being oriented adjacent to but spaced from one of the junctions between a side wall and an end wall of the basin.

12. The washer of claim 11 in which the bottom wall of the basin slopes downwards away from one end of each guide baffle, and the top surface of each guide baffle is generally horizontal.

13. The washer of claim 12 in which the lower portion of each guide baffle is wider than the upper portion of the guide baffle.

14. The washer of claim 3 in which means is provided in each end wall to accommodate the end of a support rod, so that said support rod may be mounted in the basin to support and suspend a roll of film in the basin.

15. The washer of claim 3 in which a thermometer is mounted to the basin, so that the temperature of the stream of liquid passing through the means to admit liquid and into the inlet section of the pipe may be measured.

16. The washer of claim 3 in which the basin is supported on a discrete generally planar support member, the upper surface of said support member conforming to the lower surface of the bottom wall of the basin said support member serving to raise the basin so that the basin and basin pipe and other appurtenances thereof cannot be bumped and damaged.

17. The washer of claim 3 together with means to immerse a photographic print and film rack in said basin.

18. The washer of claim 17 in which the immersion means is a substantially rectilinear retaining strip, said retaining strip being mountable to the top of said basin so that said retaining strip extends from one side wall of the basin to the other side wall.

19. The washer of claim 3 in which the side walls and the end walls slope inwards towards the bottom wall.

20. The washer of claim 3 in which the liquid is water.

* * * * *